US012077255B2

(12) United States Patent
Steed et al.

(10) Patent No.: US 12,077,255 B2
(45) **Date of Patent: *Sep. 3, 2024**

(54) WATERCRAFT WITH PEDAL-DRIVE MECHANISM

(71) Applicant: Lifetime Products, Inc., Clearfield, UT (US)

(72) Inventors: Brent R. Steed, Syracuse, UT (US); Edward G. Van Nimwegen, North Ogden, UT (US)

(73) Assignee: LIFETIME PRODUCTS, INC., Clearfield, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/048,488

(22) Filed: Oct. 21, 2022

(65) Prior Publication Data

US 2023/0103317 A1 Apr. 6, 2023

Related U.S. Application Data

(63) Continuation of application No. 17/152,346, filed on Jan. 19, 2021, now Pat. No. 11,518,481.

(60) Provisional application No. 62/964,509, filed on Jan. 22, 2020.

(51) Int. Cl.

| | |
|---|---|
| ***B63B 34/10*** | (2020.01) |
| ***B63B 5/24*** | (2006.01) |
| ***B63B 34/21*** | (2020.01) |
| ***B63H 1/14*** | (2006.01) |
| ***B63H 16/20*** | (2006.01) |

(52) U.S. Cl.

CPC ..... *B63B 34/10* (2020.02); *B63B 5/24* (2013.01); *B63B 34/21* (2020.02); *B63H 1/14* (2013.01); *B63H 16/20* (2013.01); *B63H 2016/202* (2013.01)

(58) Field of Classification Search

CPC ..... B63B 34/10; B63B 34/21; B63B 5/24; B63H 1/24; B63H 16/20

See application file for complete search history.

(56) References Cited

U.S. PATENT DOCUMENTS

| | | | | |
|---|---|---|---|---|
| 9,701,367 | B2 * | 7/2017 | McDonough | B63H 5/125 |
| 9,725,149 | B2 * | 8/2017 | Kiffmeyer | B63H 16/20 |
| 9,914,519 | B2 * | 3/2018 | Nutz | B63H 20/007 |
| 9,988,133 | B2 * | 6/2018 | Murphy | B63H 16/18 |
| 10,220,924 | B1 * | 3/2019 | Horvath | B63B 5/24 |
| 2006/0019555 | A1 * | 1/2006 | McGuinness | B63H 16/20 440/21 |
| 2009/0042461 | A1 * | 2/2009 | Walton | B63H 5/125 440/49 |
| 2016/0347435 | A1 * | 12/2016 | Kuehmichel | B63H 16/20 |

(Continued)

FOREIGN PATENT DOCUMENTS

| | | | | |
|---|---|---|---|---|
| CA | 3071455 | A1 * | 1/2019 | B63B 35/71 |

*Primary Examiner* — S. Joseph Morano
*Assistant Examiner* — Jovon E Hayes
(74) *Attorney, Agent, or Firm* — Workman Nydegger

(57) ABSTRACT

In one example, a watercraft includes a hull that defines a well extending through a bottom of the hull, a pedal-drive mechanism connected to the hull, and the pedal-drive mechanism is movable, while connected to the hull, out of the well from a deployed position to a stowed position, and a mechanism that is configured to cover a portion of the well when the pedal-drive mechanism is in the deployed position.

16 Claims, 18 Drawing Sheets

(56) References Cited

U.S. PATENT DOCUMENTS

| | | | | |
|---|---|---|---|---|
| 2019/0152574 | A1* | 5/2019 | Farber | B63H 16/20 |
| 2021/0061429 | A1* | 3/2021 | Kuehmichel | B63B 34/05 |

* cited by examiner

WATERCRAFT WITH PEDAL-DRIVE MECHANISM

FIELD OF THE INVENTION

The present invention generally relates to watercraft, examples of which include, but are not limited to, kayaks, canoes, row boats, rowing shells, paddleboats, and any other human-powered watercraft, suitable for use in water sports or other activities. At least one example embodiment embraces a watercraft that may be propelled through the use of a pedal-drive mechanism connected with a propeller.

Aspects of Some Example Embodiments

Example embodiments are concerned with a watercraft that may comprise one or more features. One example feature comprises a pedal-drive mechanism with a transmission that is configured and operable to convert a pedal motion input by a user to rotation of a propeller. A further example feature comprises a pedal-drive housing and attachment mechanism that may enable a user to readily stow/deploy a pedal-drive mechanism. Any one or more of these features, and/or other features disclosed herein, may be implemented in a single watercraft, although no particular feature or group of features is required to be implemented in any watercraft.

It is noted that the embodiments disclosed herein do not constitute an exhaustive summary of all possible embodiments. It should be noted that nothing herein should be construed as constituting an essential or indispensable element of any invention or embodiment. Rather, and as the person of ordinary skill in the art will readily appreciate, various aspects of the disclosed embodiments may be combined in a variety of ways so as to define yet further embodiments. Such further embodiments are considered as being within the scope of this disclosure.

As well, none of the embodiments embraced within the scope of this disclosure should be construed as resolving, or being limited to the resolution of, any particular problem(s). Nor should such embodiments be construed to implement, or be limited to implementation of, any particular effect(s).

Example embodiments within the scope of this disclosure may include, among other things, any one or more of the following elements. Any one or more of these elements may be included in a watercraft, examples of which are disclosed herein and include, among others, a sit-on-top kayak.

1. A pedal-drive mechanism comprising a gear train that may be operable to convert pedal motion by a user into rotation of a propeller so as to propel a watercraft to which the pedal mechanism is mounted.

2. A pedal-drive housing and attachment mechanism that may enable a user to readily stow/deploy a pedal-drive mechanism. In an embodiment, a pedal-drive housing may comprise a tray that may be movable between fore and aft positions to alternately enclose, and reveal, respectively, a recess in a watercraft by way of which a portion of a pedal-drive assembly, such as a propeller and skeg for example, may be moved between a deployed position and a stowed position. In an embodiment, a tray of a pedal-drive housing may be operable to releasably lock a pedal-drive mechanism in a deployed position.

3. Any embodiment of a kayak, or other watercraft, that includes a hull which is constructed at least partly of blow-molded, or otherwise formed, plastic may have an interior that is partly, or completely, hollow. Such embodiments may also include, disposed in the interior, one or more depressions, sometimes referred to as "tack-offs." In such embodiments, these tack-offs may be integrally formed as part of a unitary, one-piece structure during the blow-molding process. The depressions may extend from a first surface, such as a first interior surface of the hull, towards a second surface, such as a second interior surface of the hull. The ends of one or more depressions may contact or engage the second surface, or the ends of one or more of the depressions may be spaced apart from the second surface by a distance. In some instances, one or more depressions on a first interior surface may be substantially aligned with corresponding depressions on a second interior surface, and one or more depressions on the first interior surface may contact one or more corresponding depressions on the second interior surface or, alternatively, one or more depressions on the first interior surface may be spaced apart from corresponding depressions on the second interior surface. In still other instances, depressions that contact each other and depressions that are spaced apart from each other may both be present in a kayak or other watercraft. The depressions may be sized and configured to strengthen and/or reinforce the blow-molded plastic hull of the kayak or other watercraft. Finally, the depression, or depressions, can be any shape or size, and depressions of different respective shapes and/or sizes can be combined in a single watercraft.

BRIEF DESCRIPTION OF THE DRAWINGS

The appended drawings contain figures of various example embodiments to further illustrate and clarify the above and other aspects of example embodiments of the present invention. It will be appreciated that these drawings depict only example embodiments of the invention and are not intended to limit its scope. The invention will be described and explained with additional specificity and detail through the use of the accompanying drawings.

DETAILED DESCRIPTION OF SOME EXAMPLE EMBODIMENTS

Figure 1:
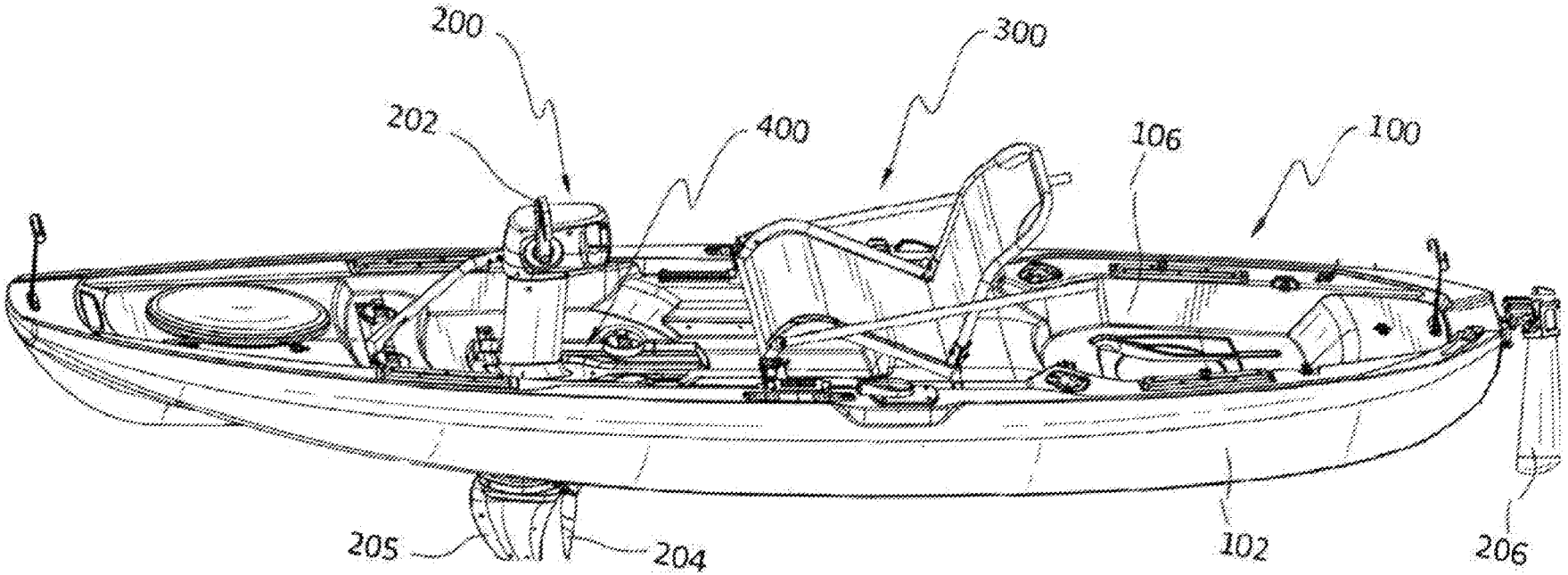
FIGS. 1-4 disclose aspects of an example watercraft.

With reference now to the figures, details are provided concerning aspects of example embodiments of the invention. Such embodiments may comprise, or be employed with, a variety of different watercraft, examples of which include, but are not limited to, kayaks such as sit-inside kayaks and sit-on-top kayaks, canoes, row boats, rowing shells, paddleboats, and any other human-powered watercraft, suitable for use in water sports or other activities.

A. General Aspects of Some Example Embodiments

In general, the watercraft and components disclosed herein may be constructed with a variety of elements and materials including, but not limited to, plastic (including blow molded plastic structures and elements) such as high density polyethylene (HDPE), including polycarbonates, composites, metals, and combinations of any of the foregoing. A variety of molding processes may be employed in the construction of one or more example embodiments, where such molding processes include, but are not limited to, blow molding, rotomolding, twin sheet molding, injection molding, and stretch blow molding.

Suitable metals employed in one or more example embodiments may include steel, stainless steel, aluminum, aluminum alloys, bronze, nickel, copper, copper-nickel alloys, and brass, although the skilled person will understand that a variety of other metals may be employed as well and the scope of the invention is not limited to the foregoing examples. Where metal is employed in the construction of a component, the metal elements may take one or more forms including, but not limited to, pipe, square tube, rectangular tube, round tube, angles, flat bar, I-shapes, T-shapes, L-shapes, and combinations and portions of any of the foregoing.

Depending upon the material(s) employed in the construction of one or more embodiments, a variety of methods and components may be used to connect, releasably or permanently, various elements of one or more embodiments. For example, the various elements of components within the scope of this disclosure may be attached to each other by any one or more of allied processes such as welding or brazing, soldering, and/or mechanically by way of fasteners such as bolts, screws, pins, and rivets, for example.

Some, none, or all of, portions of a one or more of the disclosed components may be coated or otherwise covered with paint, rubber, plastic or other materials, or any combination of the foregoing. Surface treatments and textures may also be applied to elements of the disclosed embodiments. At least some of such materials may serve to help prevent, or reduce, rust and corrosion. Various other materials that may be employed in one or more components and elements are disclosed elsewhere herein.

Finally, the present disclosure refers to various elements being connected to each other in various ways. Such elements may be connected directly to each other, or indirectly to each other. Where no particular connection is specified, the various elements may be connected either directly, or indirectly, to each other.

In the case of a direct connection, a first element may be releasably connected to a second element and held in that arrangement by one or more retaining elements such as a pin, sleeve, bolt, rivet, shaft, or stud, to name some examples. Alternatively, and still with reference to the case of the direct connection, the first element and second element may be directly, and permanently, connected to each other such as by welding, brazing, or any other process that effects a permanent connection between the elements. With reference to the case of an indirect connection, a first element may be indirectly connected to a second element by virtue of both of those elements being connected to one or more intervening elements. This indirect connection may be implemented by way of by one or more retaining elements such as a pin, sleeve, bolt, rivet, shaft, or stud, to name some examples. Alternatively, and still with reference to the case of an indirect connection, the first element and second element may be indirectly, and permanently, connected to each other by way of one or more intervening elements to which the first element and second element are attached, such as by welding, brazing, or any other process that effects a permanent connection between the elements.

B. Aspects of an Example Watercraft

With attention first to FIGS. 1-4, a watercraft 100, such as a sit-on-top kayak for example, is disclosed that includes a hull 102. The hull 102 may be an integral plastic blow-molded structure of a unified, single-piece construction. In other embodiments, the hull 102 may be constructed using processes such as injection molding, stretch blow molding, rotomolding, or twin sheet molding. The hull 102 may be hollow.

The example watercraft 100 may comprise a variety of different components. For example, the watercraft 100 may include a pedal-drive mechanism 200 mounted to the hull 102, and at least partly disposed in a forward cockpit 104 of the watercraft 100. In general, the pedal-drive mechanism 200 may be configured and arranged to enable a user to propel the watercraft 100 by rotating, such as with the feet of the user, pedals 202 to effect rotation of a propeller 204 that is connected directly or indirectly to the pedals 202. The pedals 202 may be rotated forward to move the watercraft 100 forward, or in reverse to rotate the propeller 204 in such a direction that the watercraft moves backwards. In some embodiments, the pedals 202 and propeller 204 may be configured and arranged such that the watercraft 100 can only be moved in the forward direction, and not in the reverse direction. For example, a mechanical stop or other anti-reverse mechanism may be provided that prevents the pedals 202 and, thus, the propeller 204, from moving in reverse.

The propeller 204 may be protected by a skeg 205 positioned forward of the propeller 204. In particular, as the watercraft 100 moves forward, the skeg 205 may push objects and materials, such as weeds, floating objects, or submerged objects, for example, out of the way so that such objects and materials are less likely to foul or otherwise impede the propeller 204. As well, if the watercraft 100 impacts an object for some reason, the skeg 205 may take the brunt of the impact since it is located forward of the propeller 204, and thereby protect the propeller 204. The watercraft 100 may further include a rudder 206 by way of which a user may manually steer the watercraft 100.

In general, the skeg 205 and propeller 204 may, together, define a portion of a lower unit 203 (see, e.g., FIG. 2) of the pedal-drive mechanism 200. This lower unit 203 may be connected at the bottom end of a midsection 207 of the pedal-drive mechanism 200. A power unit 209, which may include the pedals 202, is connected at the upper end of the midsection 207. The power unit 209, midsection 207, and lower unit 203, may comprise gears and other mechanisms to convert rotary motion of the pedals 202 to rotary motion of a shaft (not shown) to which the propeller 204 is mounted.

Figure 4:
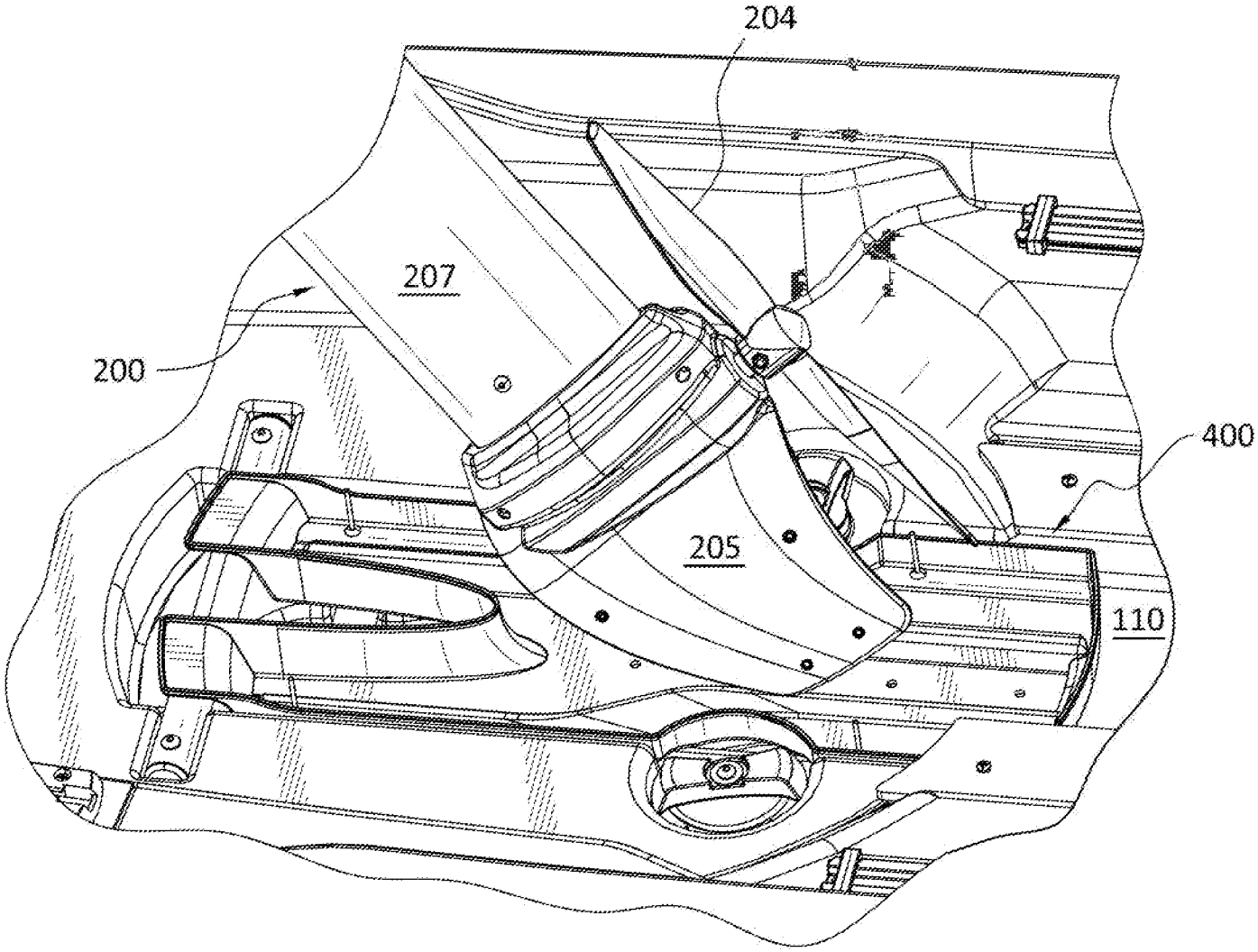
Figure 5:
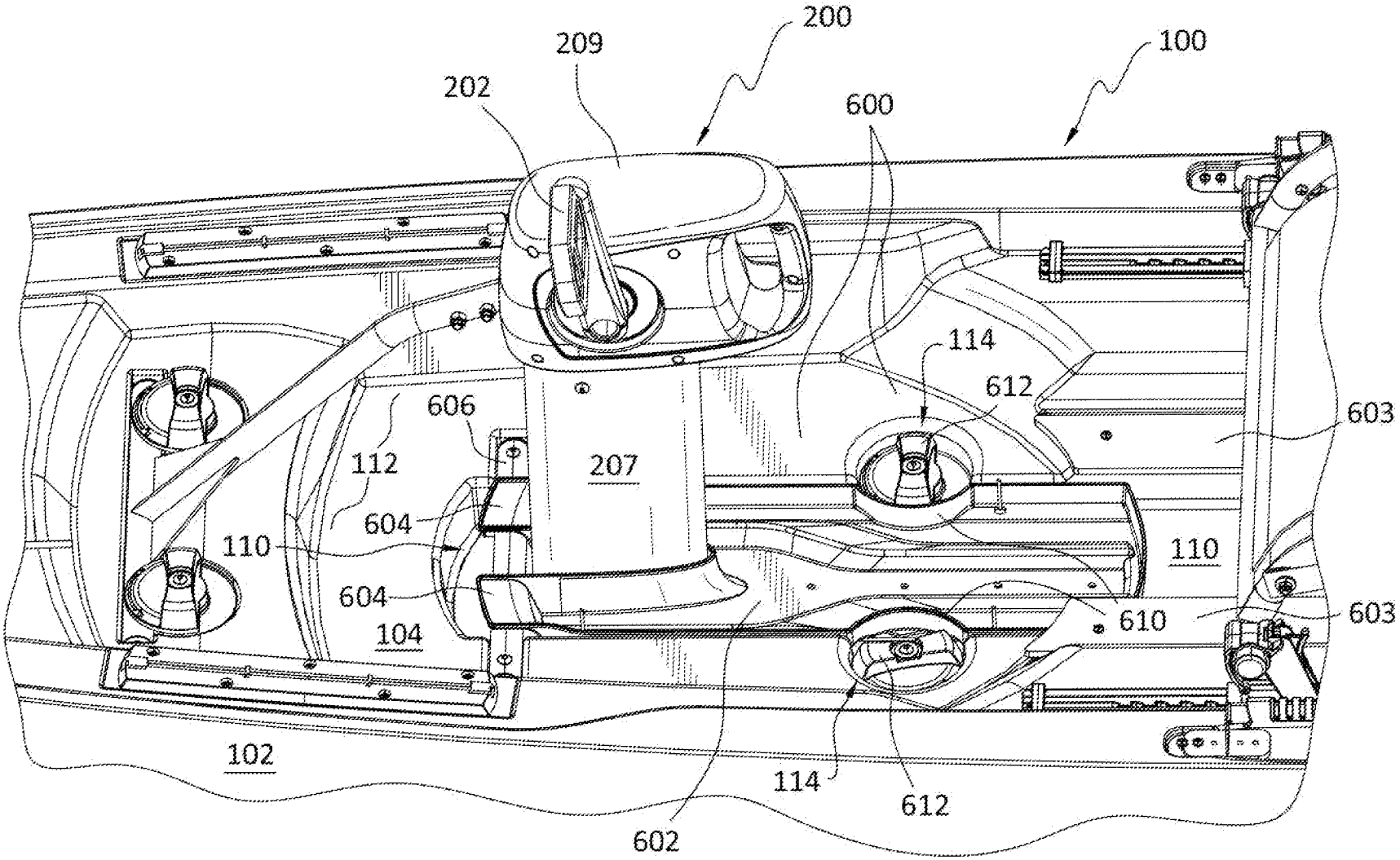
FIGS. 5-21 disclose aspects of an example pedal-drive housing and attachment mechanism.
Figure 6:
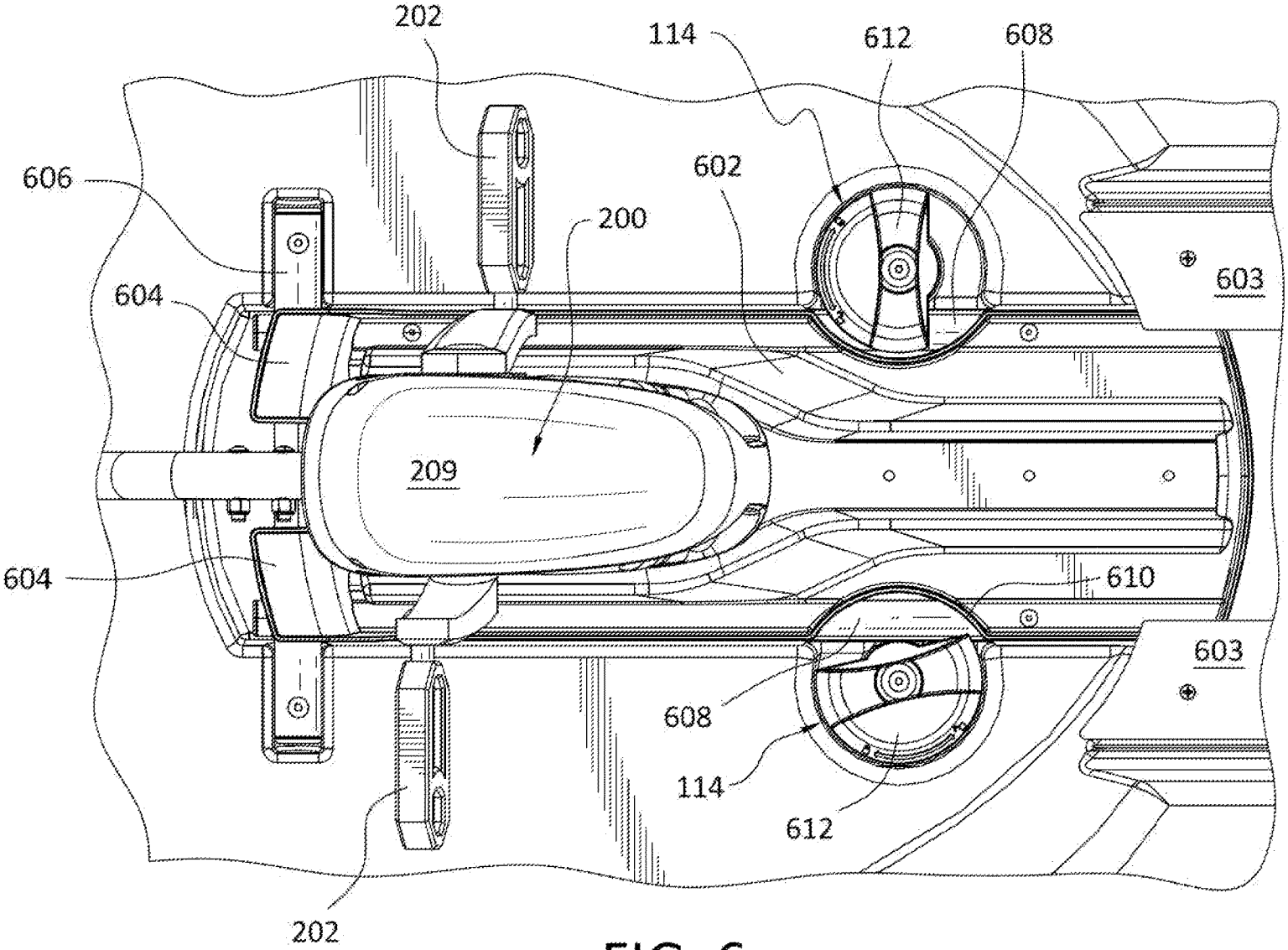
Figure 7:
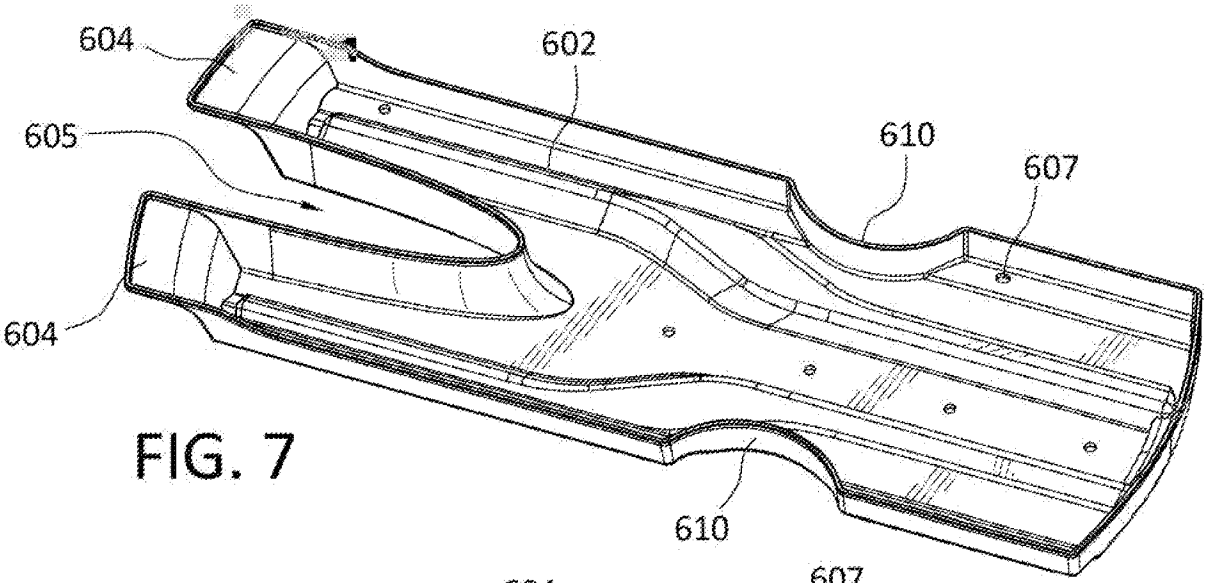
Figure 8:
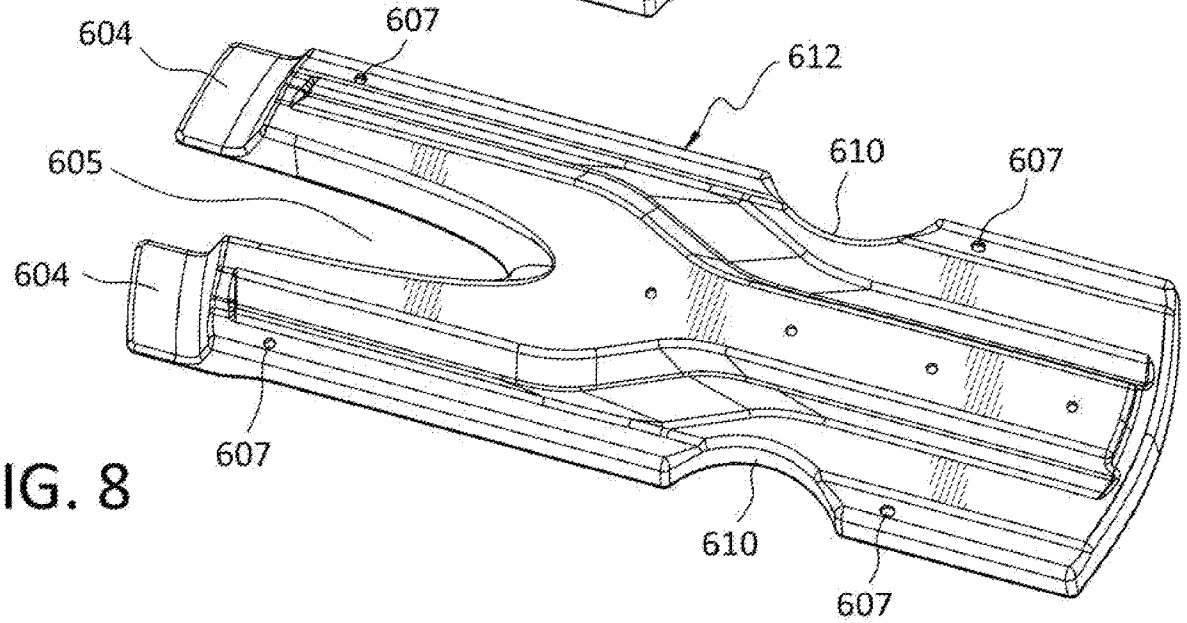

As exemplified in FIGS. 4 and 5, the pedal-drive mechanism 200 may be movable, such as by rotation about a shaft, between a stowed position (FIG. 4) and a deployed position (FIG. 5). As shown in FIG. 4, when the pedal-drive mechanism 200 is in the stowed position, the lower unit 203 may be disposed at an angle, such as between about 20 degrees and about 40 degrees for example, relative to horizontal and, thus positioned, no portion of the lower unit 203 is disposed beneath the watercraft 100. As shown in FIG. 5, when the pedal-drive mechanism 200 is in the deployed position, the midsection 207 may be perpendicular, or within about 5 degrees to about 10 degrees of perpendicular, relative to horizontal. In the deployed position, the lower unit 203 may be positioned entirely beneath the bottom of the watercraft 100. As well, a portion of the midsection 207 may likewise be positioned beneath the bottom of the watercraft 100 when the pedal-drive mechanism 200 is in the deployed position.

Figure 2:
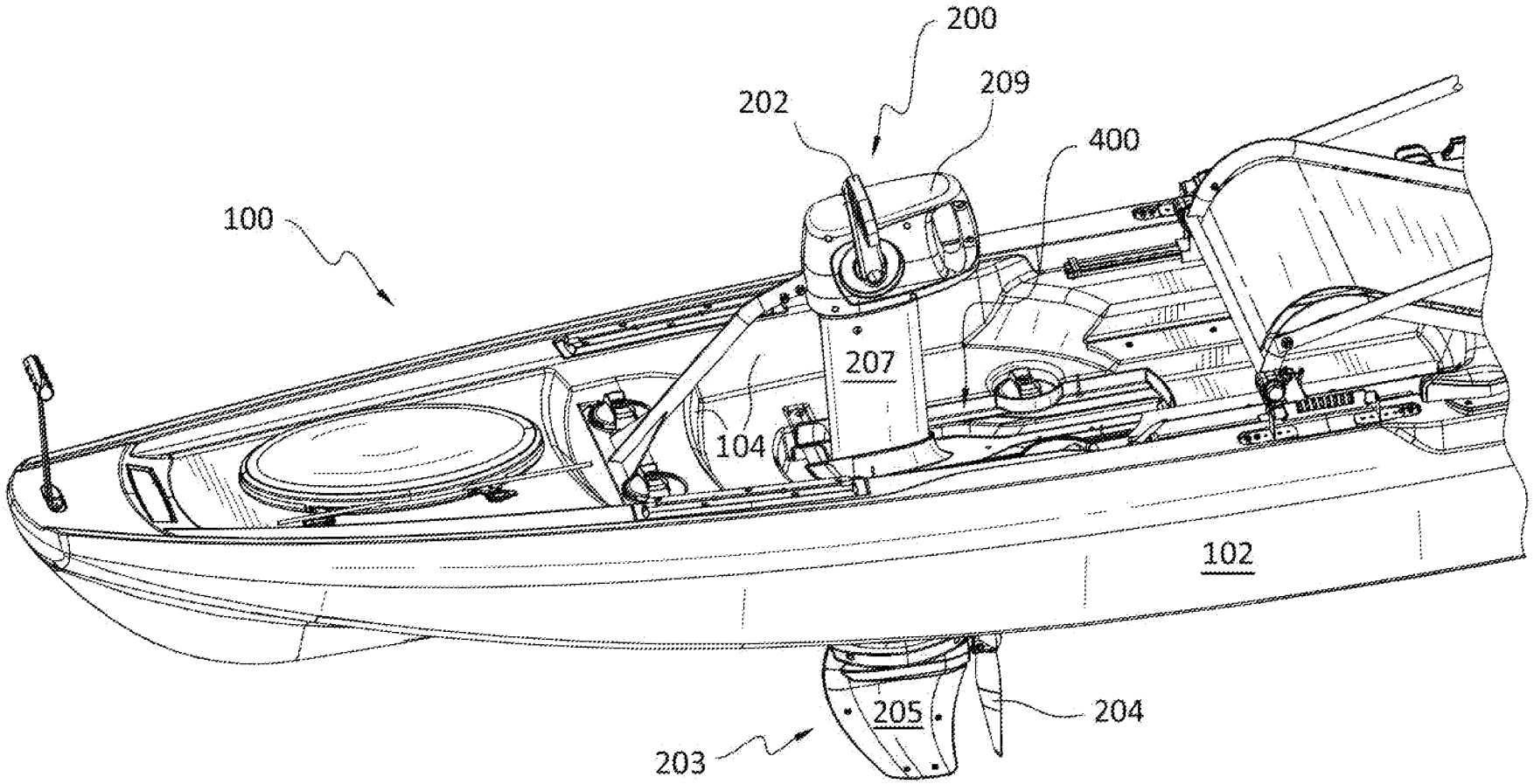
Figure 3:
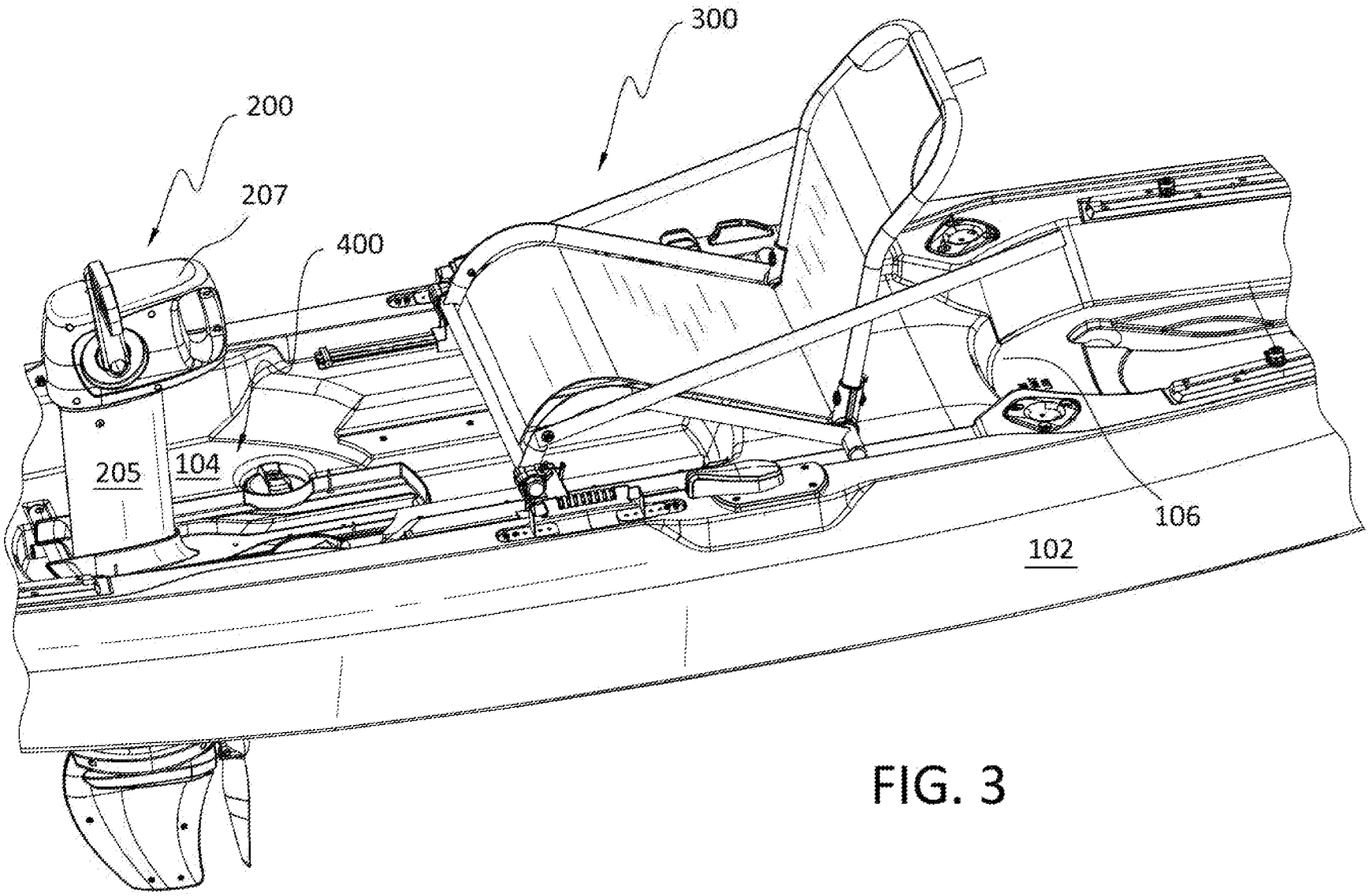

With continued reference now to FIGS. 1-3 in particular, watercraft 100 may comprise one or more seats 300. In the example of FIGS. 1-4, a seat 300 is positioned between the forward cockpit 104 and an aft cockpit 106. One or more seats 300 may be provided in the watercraft 100. In other embodiments, a seat 300 may be positioned in or near the aft cockpit 106, and the pedal-drive mechanism 200 may be positioned at about the middle of the watercraft 100, that is, about midway between the bow and stern of the watercraft 100. More generally, the seat 300 may be positioned anywhere in the watercraft 100 where a user is able to sit in the seat 300 and reach the pedals 202. Likewise, the pedal-drive mechanism 200 may be positioned anywhere in the watercraft 100 where a user, seated in a seat 300, can reach the pedals 202.

The watercraft 100 may comprise a pedal-drive housing 400 that may enable a user to readily stow/deploy the pedal-drive mechanism 200. The pedal-drive housing 400 may help to secure the pedal-drive mechanism 200 in the deployed position, shown in FIG. 1 and FIG. 5, for example. As well, the pedal-drive housing 400 may act as a rest for the pedal-drive mechanism 200 when the pedal-drive mechanism 200 is in the stowed position, shown in FIG. 4.

C. Pedal-Drive Housing and Attachment Mechanism

With continuing attention to FIGS. 1-4, and directing attention now to FIGS. 5-21 as well, details are provided concerning some embodiments of a pedal-drive housing and attachment mechanism (which may be referred to herein by the shorthand notation 'housing'), one example of which is denoted generally at 600. Among other things, embodiments of a pedal-drive housing and attachment mechanism may enable a user to readily stow/deploy a pedal-drive mechanism, one example of which is the pedal-drive mechanism 200.

Figure 12:
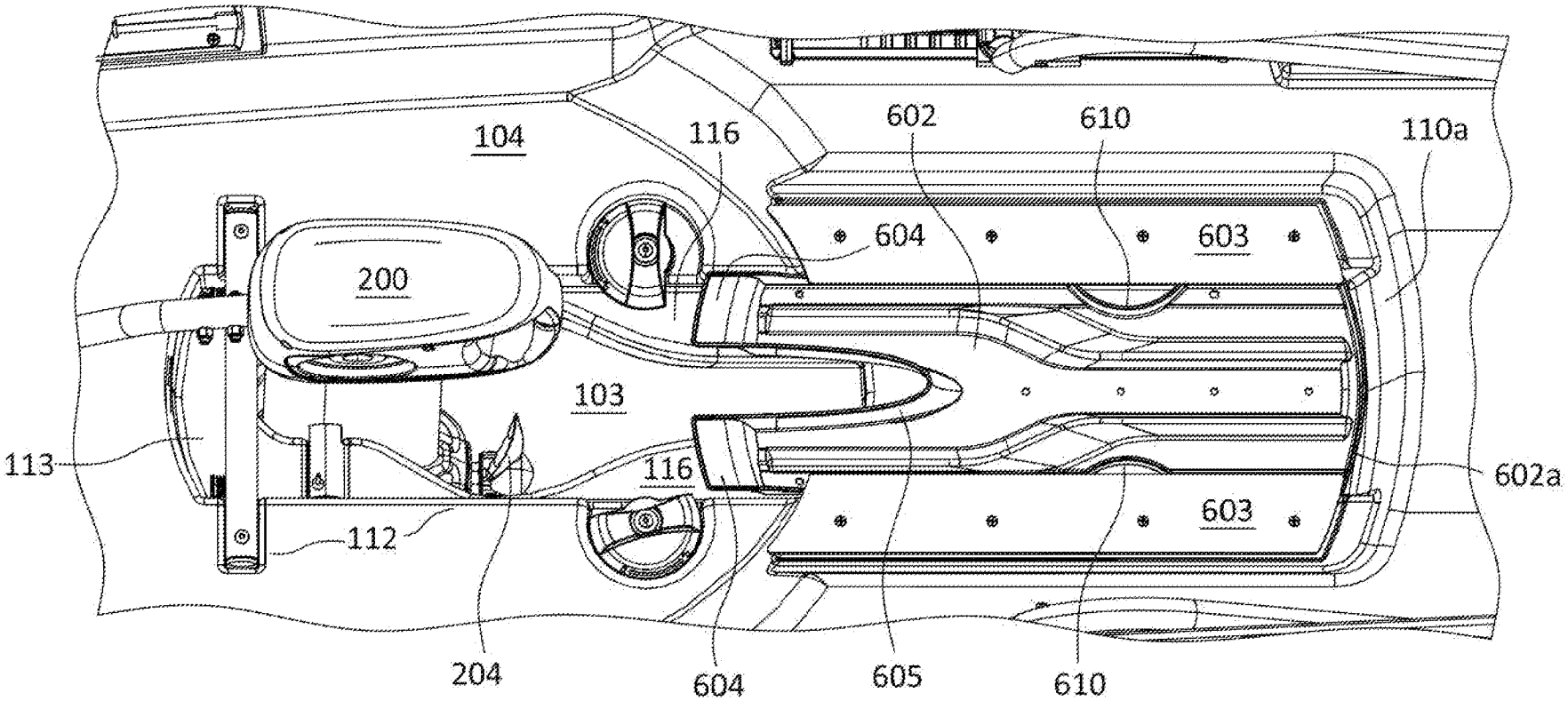
Figure 13:
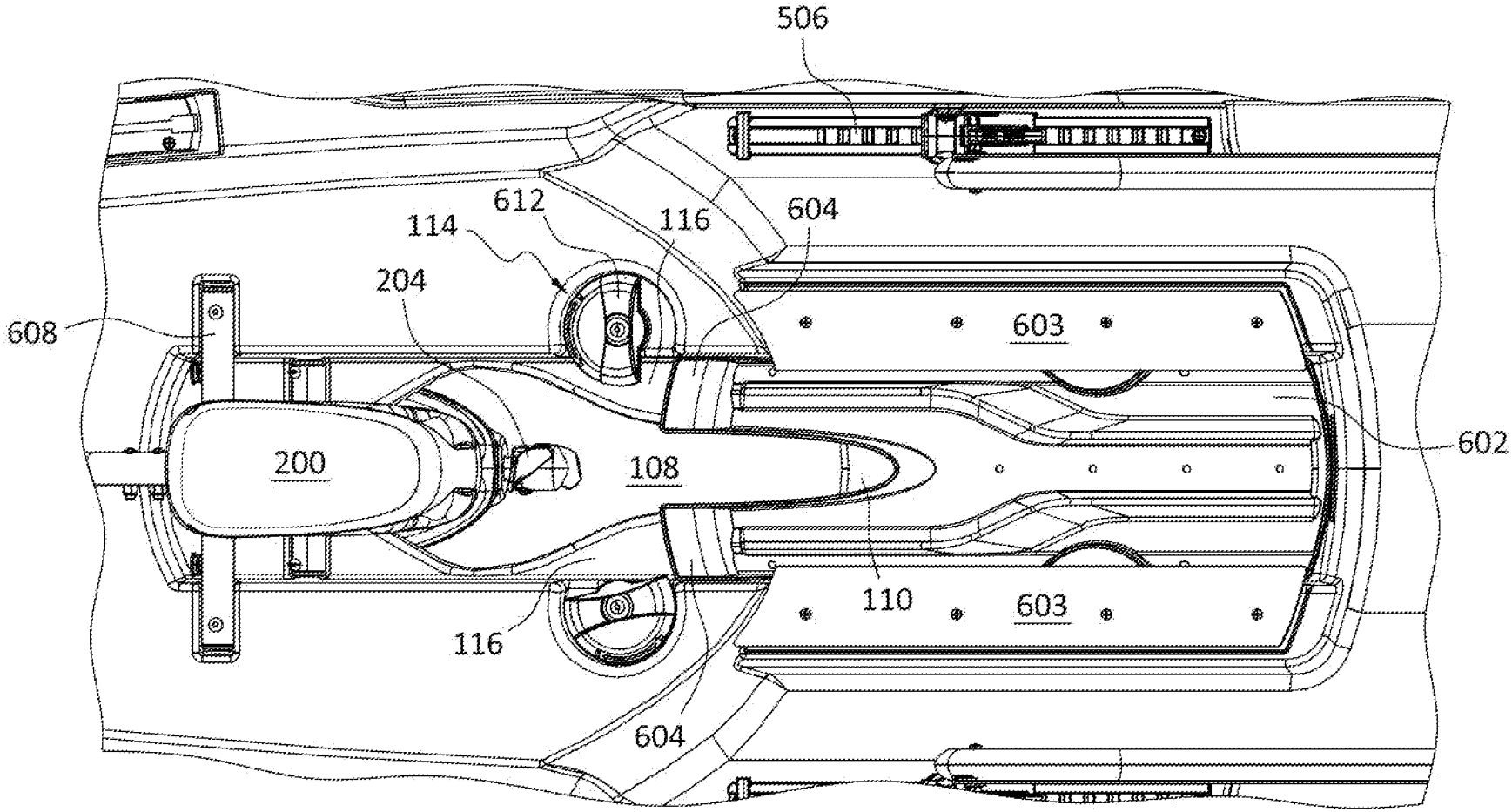

As indicated in the Figures, the housing 600 may comprise a tray 602 that is configured to move back and forth, such as by sliding, between a forward position (FIG. 5, for example) and an aft position (FIG. 12, for example). In some embodiments, the tray 602 may take the form of an integral plastic blow-molded structure of a unified, single-piece construction. Alternatively, the tray 602 may be made of fiberglass, or composites such as carbon fiber composites. In still other embodiments, the tray 602 may be made of one or more metals, such as aluminum. Further, other embodiments of the tray 602 may be made of injection molded plastic. In some embodiments, the tray 602 may be made of multiple different materials, such as metal and plastic for example.

When disposed in the forward position, the tray 602 may substantially, or completely, cover a well 108 that extends completely through the forward cockpit 104 and down through the bottom of the hull 102. The well 108 may be configured and arranged to enable the pedal-drive mechanism 200 to be moved, such as by rotation for example, between a deployed position and a stowed position.

The tray 602 may reside in the forward position both when the pedal-drive mechanism 200 is in the deployed position (see, e.g., FIG. 5), and also when the pedal-drive mechanism 200 is in the stowed position (see FIG. 4). As well, the tray 602 may be movable from the forward position to the aft position to enable movement of the pedal-drive mechanism 200 to/from a deployed position (see, e.g., FIG. 10) from/to a stowed position (see, e.g., FIG. 4). The movement of the tray 602 between the forward and aft positions may be a sliding, or translational, movement. When disposed in the aft position, the tray 602 may partly, or completely, reside in an upper tray recess 110 defined in the hull 102, and as shown in FIG. 12 for example, a back edge 602*a* of the tray 602 may be spaced apart from, or in contact with, a back wall 110*a* of the upper tray recess 110. One or more retention elements 603, which may be made of metal or plastic for example, may be attached on respective sides of the upper tray recess 110 and extend partway over the tray 602 (see, e.g., FIGS. 11 and 13) so as to prevent the tray 602 from lifting up out of the upper tray recess 110. In some embodiments, one or both of the retention elements 603 may be removable.

Figure 10:
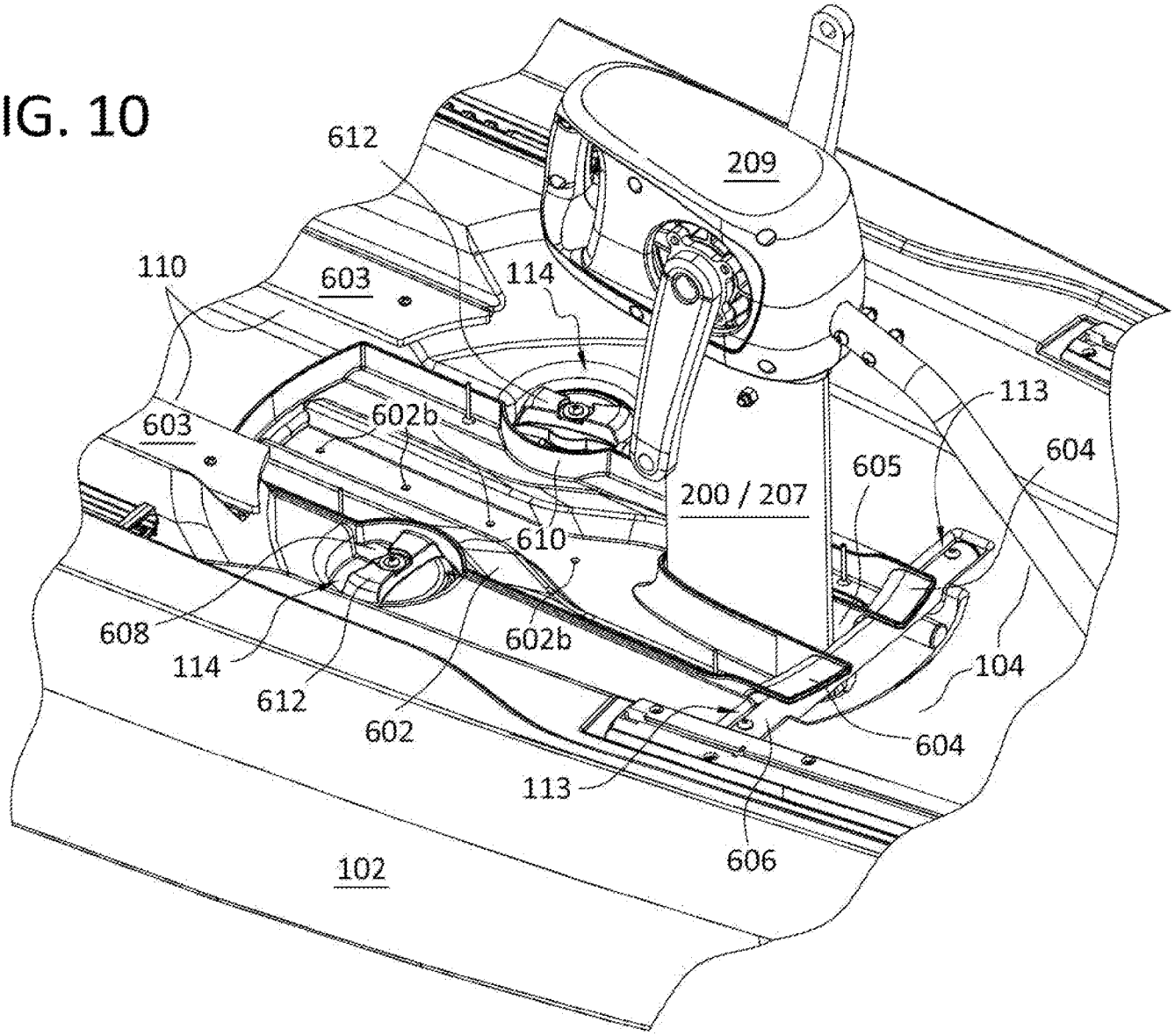
Figure 11:
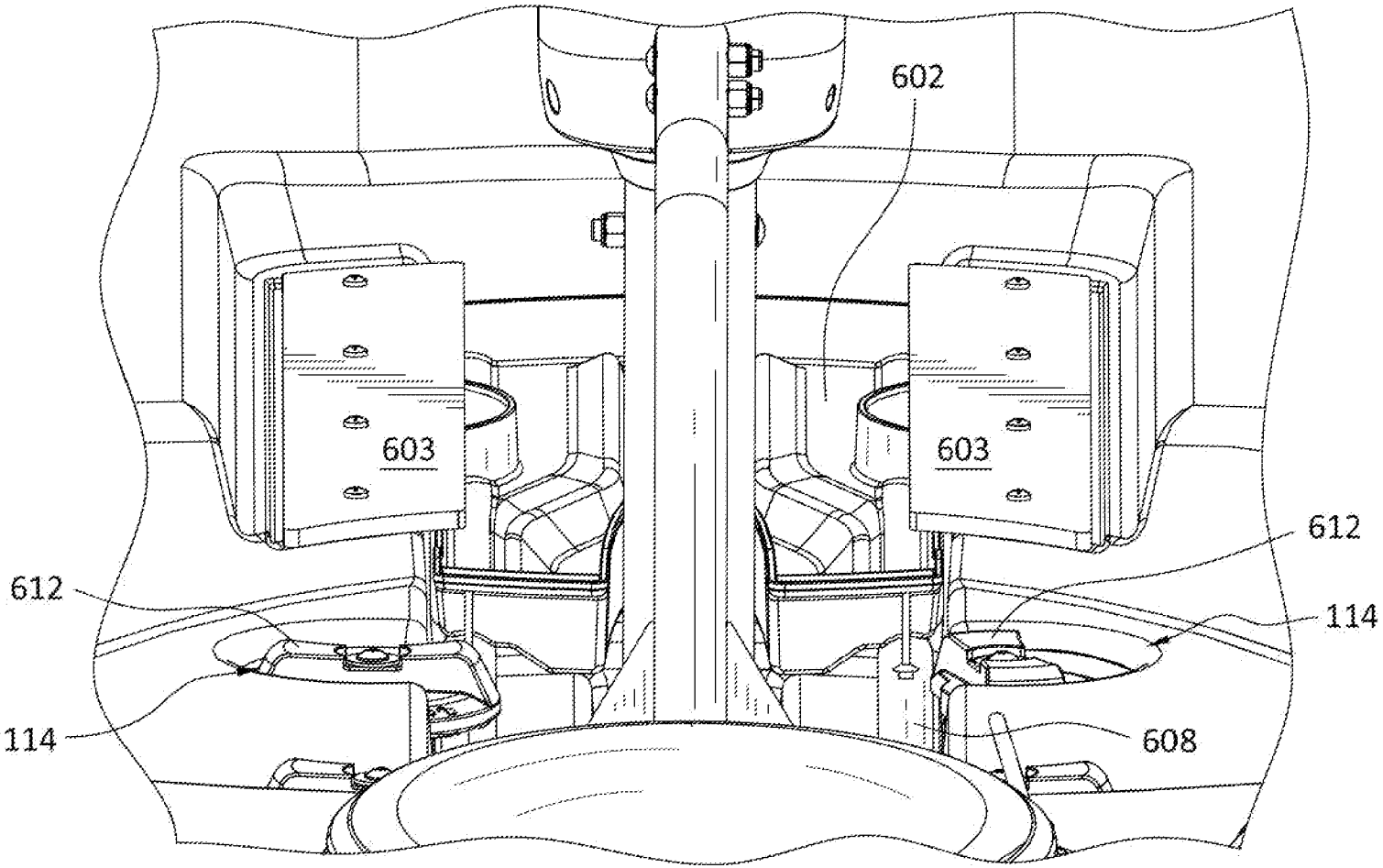

With continued reference to FIGS. 5-8 for example, the tray 602 may include various elements. For example, the tray 602 may include one or more arms 604 that may cooperate with each other to define a cutout 605 configured and arranged to align with the well 108 when the tray 602 is in the aft position (see, e.g., FIG. 12). In this way, a clear and unobstructed path may be defined for movement of the pedal-drive mechanism 200 between the deployed and stowed positions. As shown in FIG. 10, when the tray 602 is in the forward position, the pedal-drive mechanism 200 may extend downward through the cutout 605. Thus positioned, the tray 602 may help to limit the ingress of water from the well 108 into the forward cockpit 104. Where water should happen to make its way into the tray 602, whether from above the tray 602 and/or below the tray 602, the water may drain out of the tray 602 through one or more drain holes 602*b* located at the lowest portion of the tray 602, and then pass from the drain holes 602*b* to the well 108.

Figure 16:
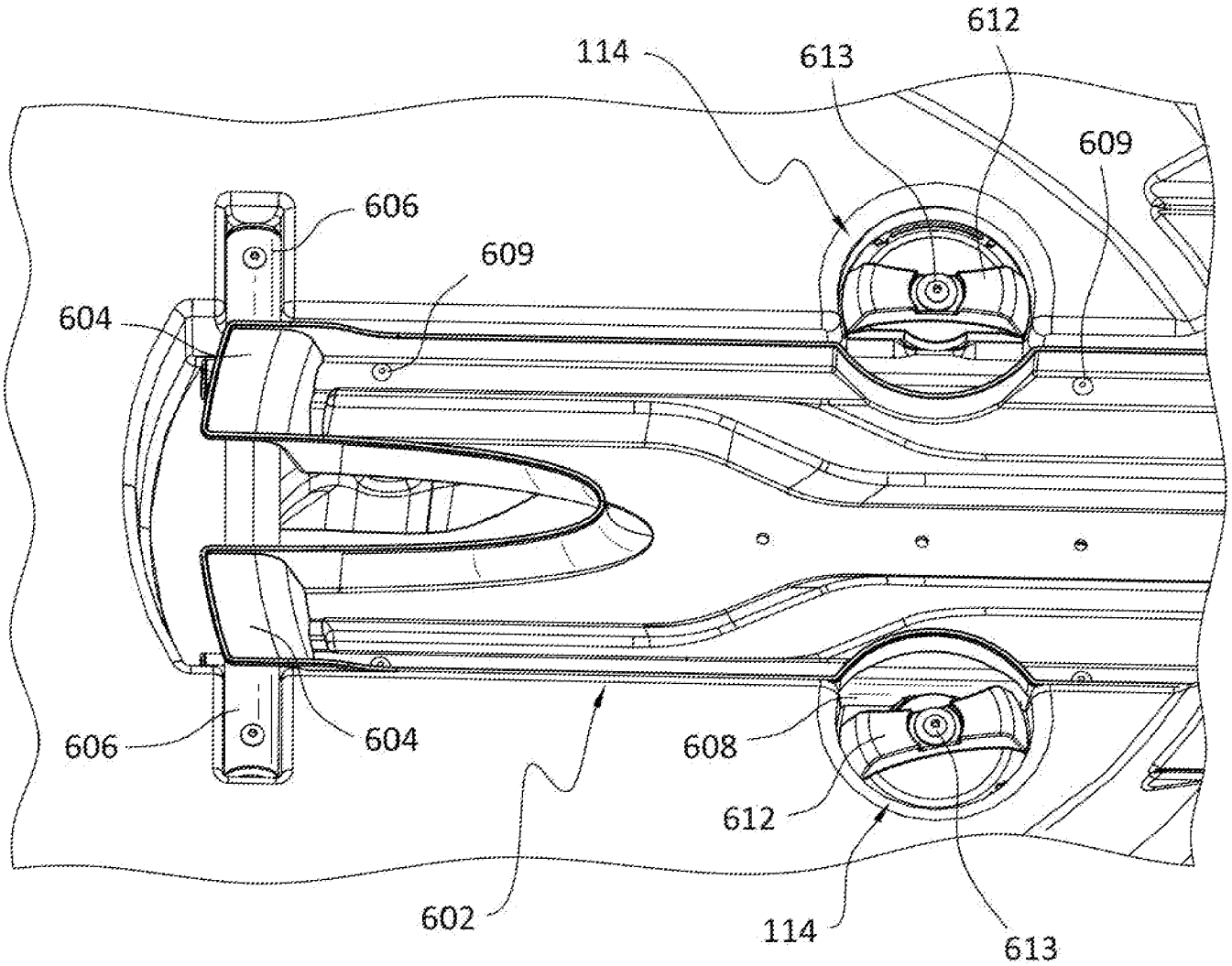
Figure 17:
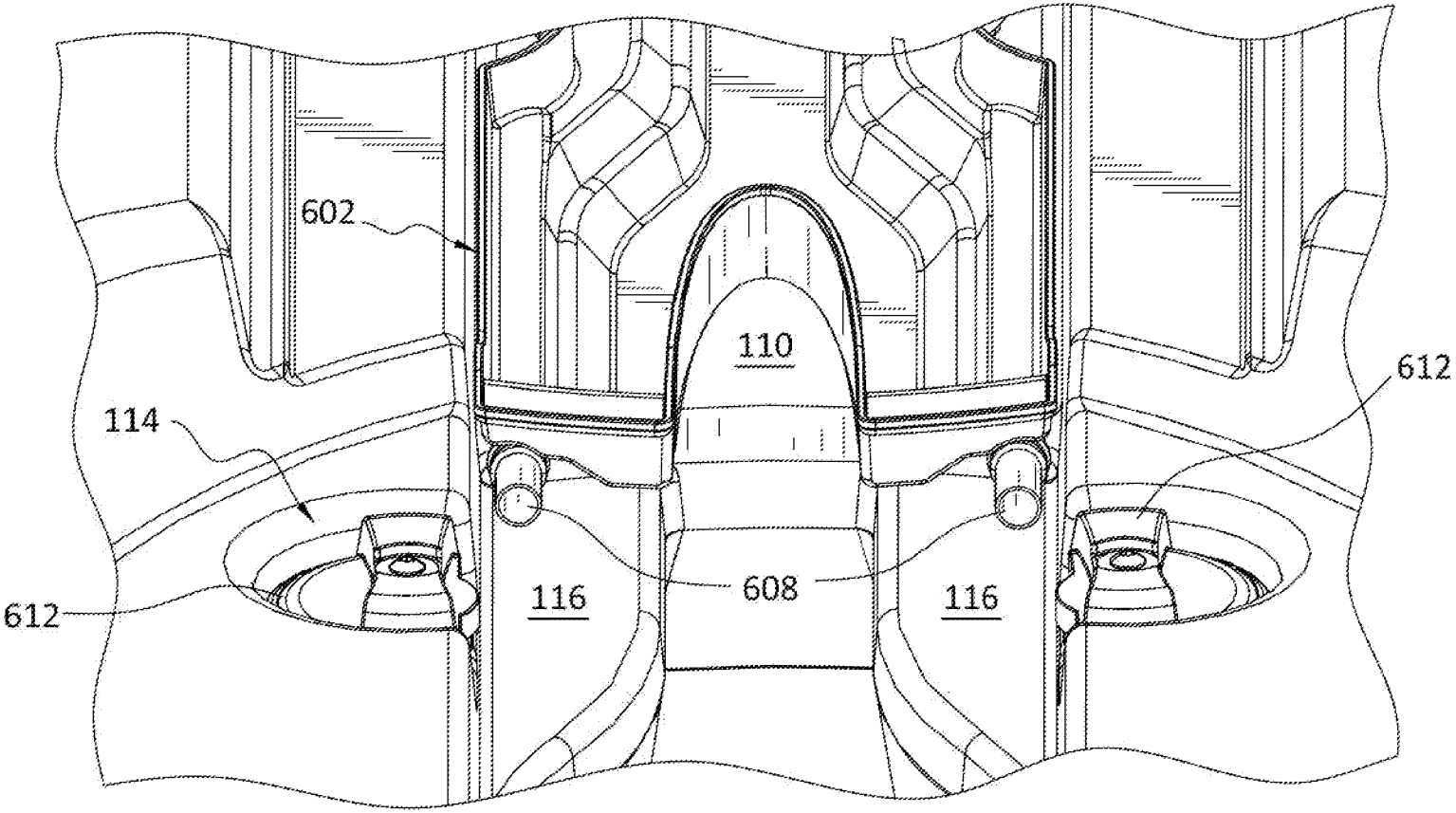
Figure 19:
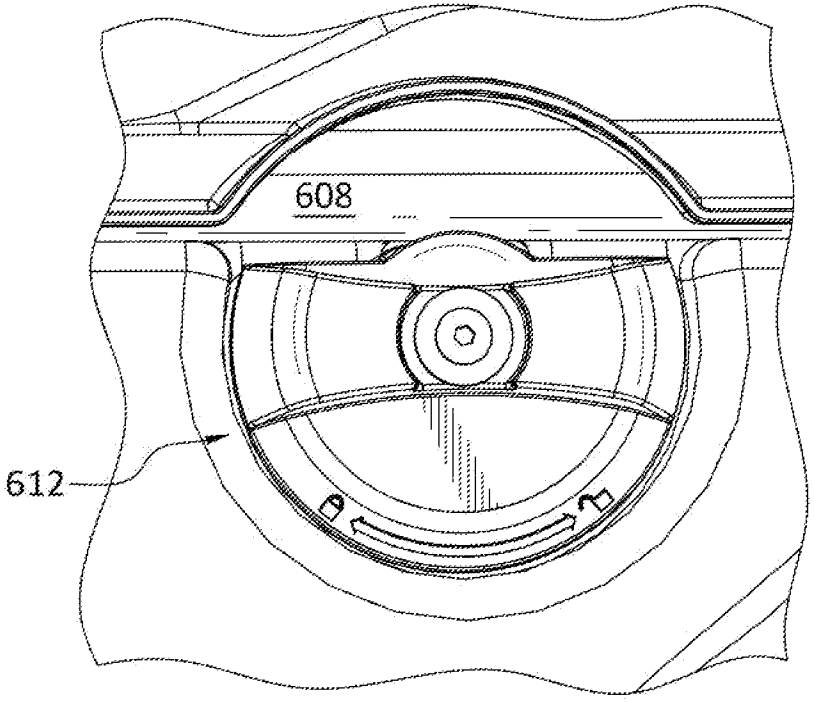
Figure 18:
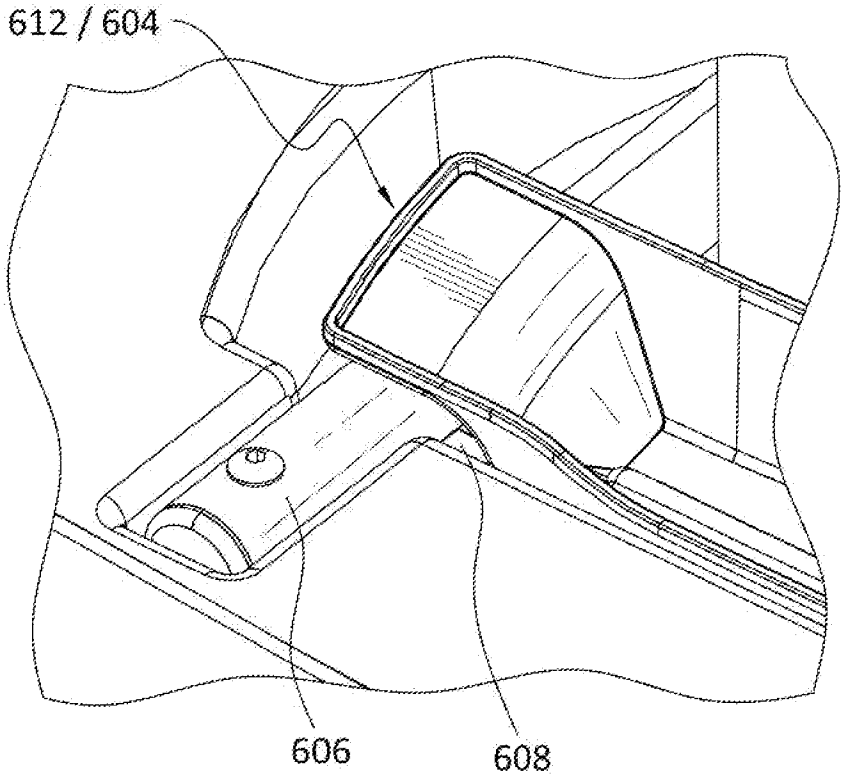
Figure 21:
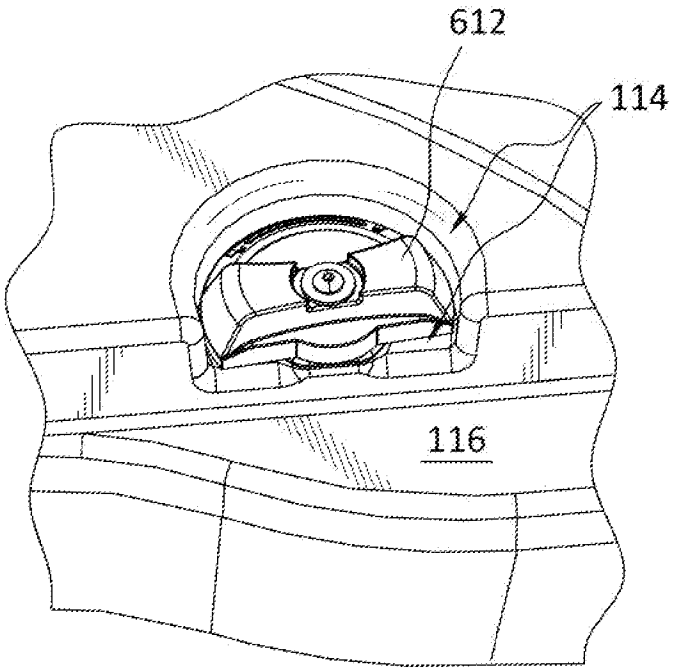
Figure 20:
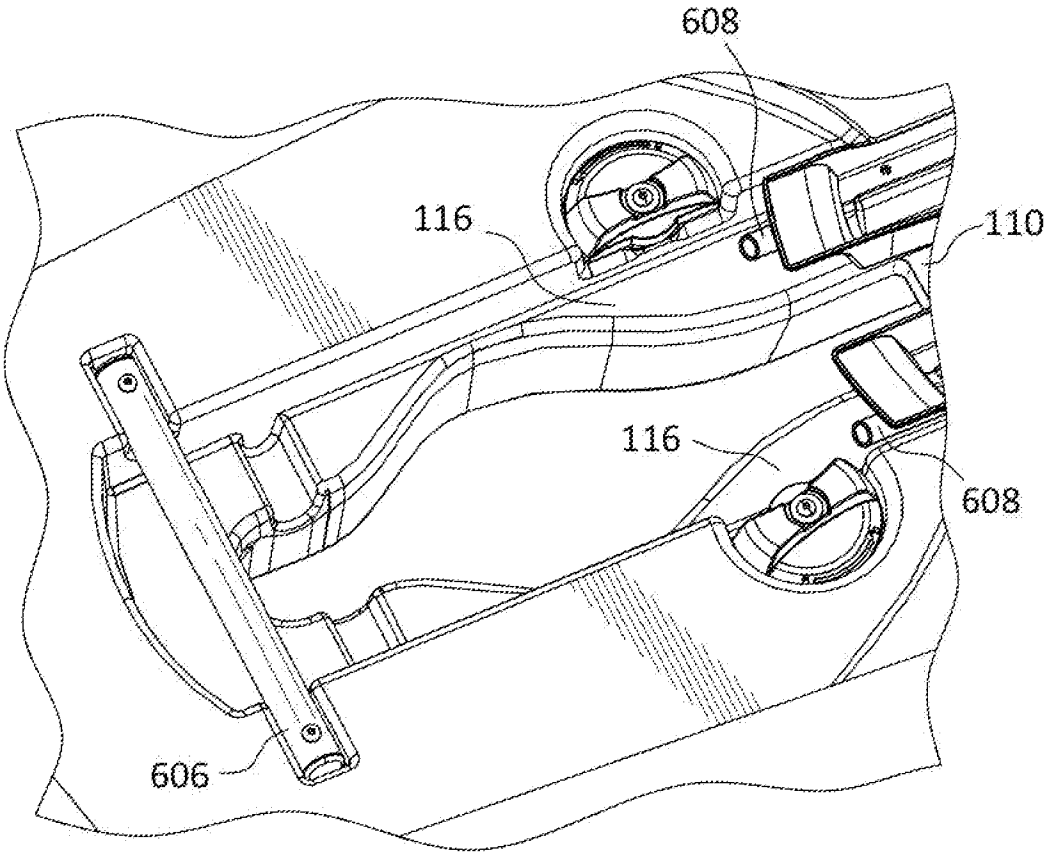

With continued reference to the arms 604, and as shown in FIGS. 16 and 17 for example, those may comprise respective terminal portions which may be configured to extend over, and possibly reside in contact with, a crossbar 606 when the tray 602 is in the forward position. As shown, the crossbar 606, which may be made of a metal tube for example, may reside in a recess 113 defined in the forward cockpit 104 (see, e.g., FIG. 12), such that the uppermost surface of the crossbar 606 may be flush with, or slightly below, the surface of the deck 112 in the forward cockpit 104.

Figure 15:
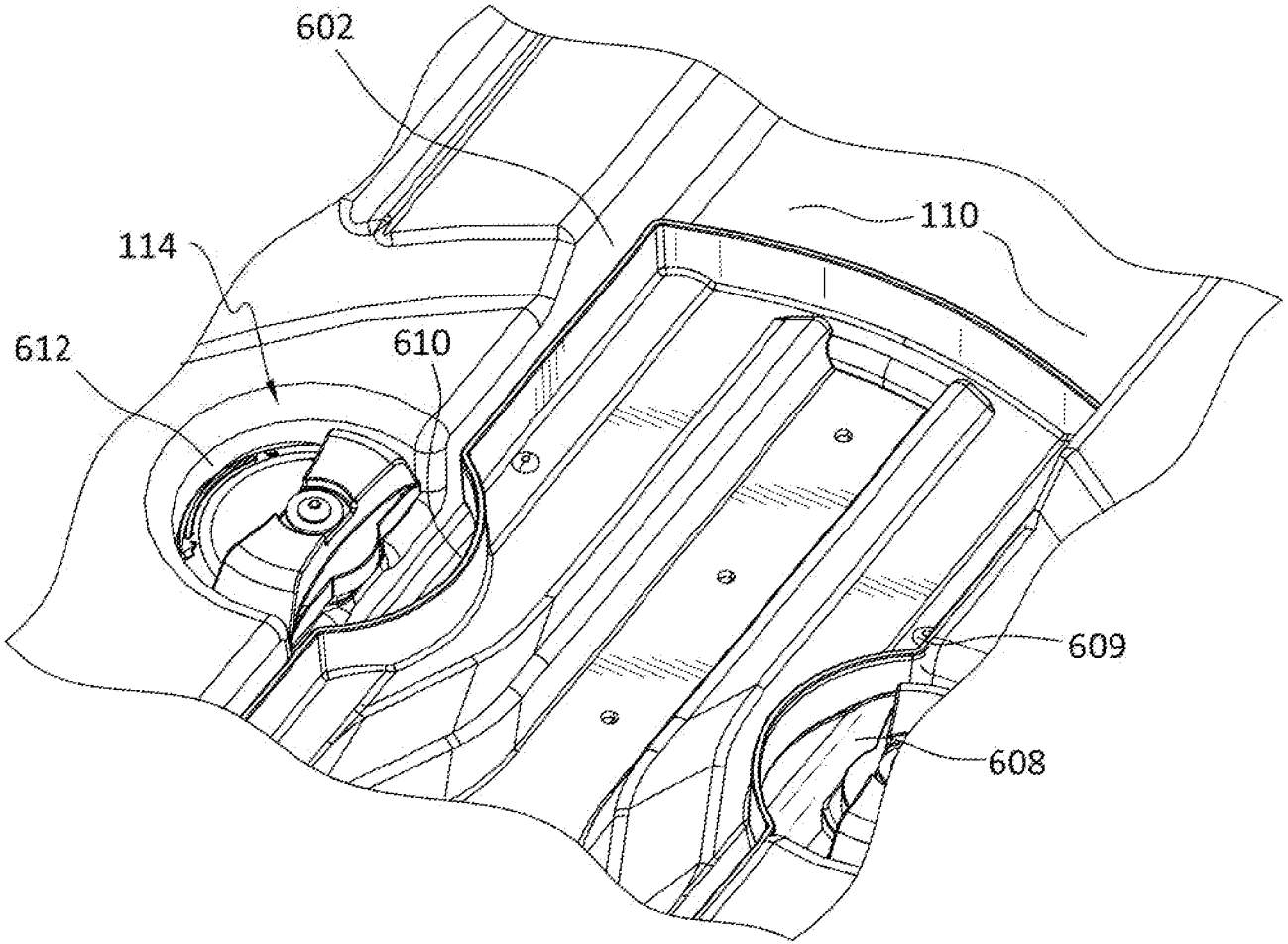

Embodiments of the tray 602 may also comprise one or more runners 608 attached to the underside of the tray 602 by way of fasteners 609 extending through holes 607 (see, e.g., FIG. 8) defined in the tray 602. The runners 608 may extend lengthwise with respect to the tray 602. In some embodiments, the runners 608 may comprise, for example, respective pieces of metal tube, such as aluminum tube for example. As shown in FIGS. 15 and 16 for example, the tray 602 may include cutouts 610 that serve to expose respective portions of the runners 608 so that when the tray 602 is in the forward position, the exposed portions of the runners 608 are positioned proximate respective recesses 114, which may be generally circular in shape or comprise a shape of a portion of a circle, defined in the deck 112. Respective dogs 612, which may be made of plastic or metal for example, may be disposed in each of the recesses 114 and rotatably connected to the hull 102 with fasteners 613 about which the dogs 612 may be rotatable. The tray 602 may be secured in its fore-and-aft position by rotating the dogs 612 so that they are positioned over the respective exposed portions of the runners 608.

As shown in FIG. 16 for example, the recess 114 and a cutout 610 of the tray 602 may collectively define a generally circular opening, or a portion of a generally circular opening, within which the dog 612 may be rotatable. In some embodiments, the dogs 612 may have a rotational range of motion of about 180 degrees, but the range of motion may be less, or greater, than 180 degrees. The tray 602 may be released, so that it is movable in the fore-and-aft direction, by rotating the dogs 612 so that the dogs 612 are moved to respective positions where the runners 608 are exposed, as seen in the example of FIG. 16. The tray 602 may then be slid aft to the position shown in FIG. 12.

Figure 9:
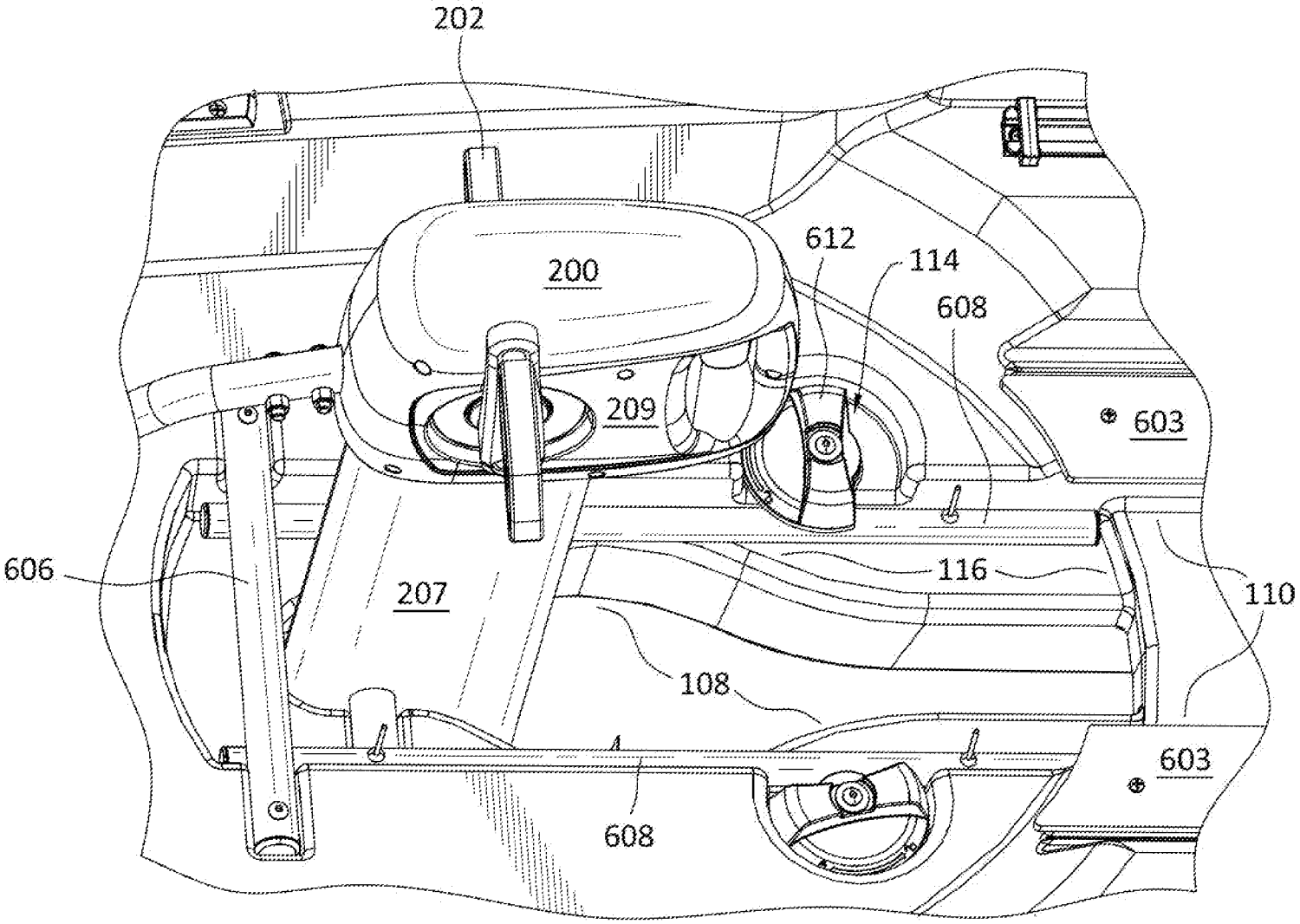
Figure 14:
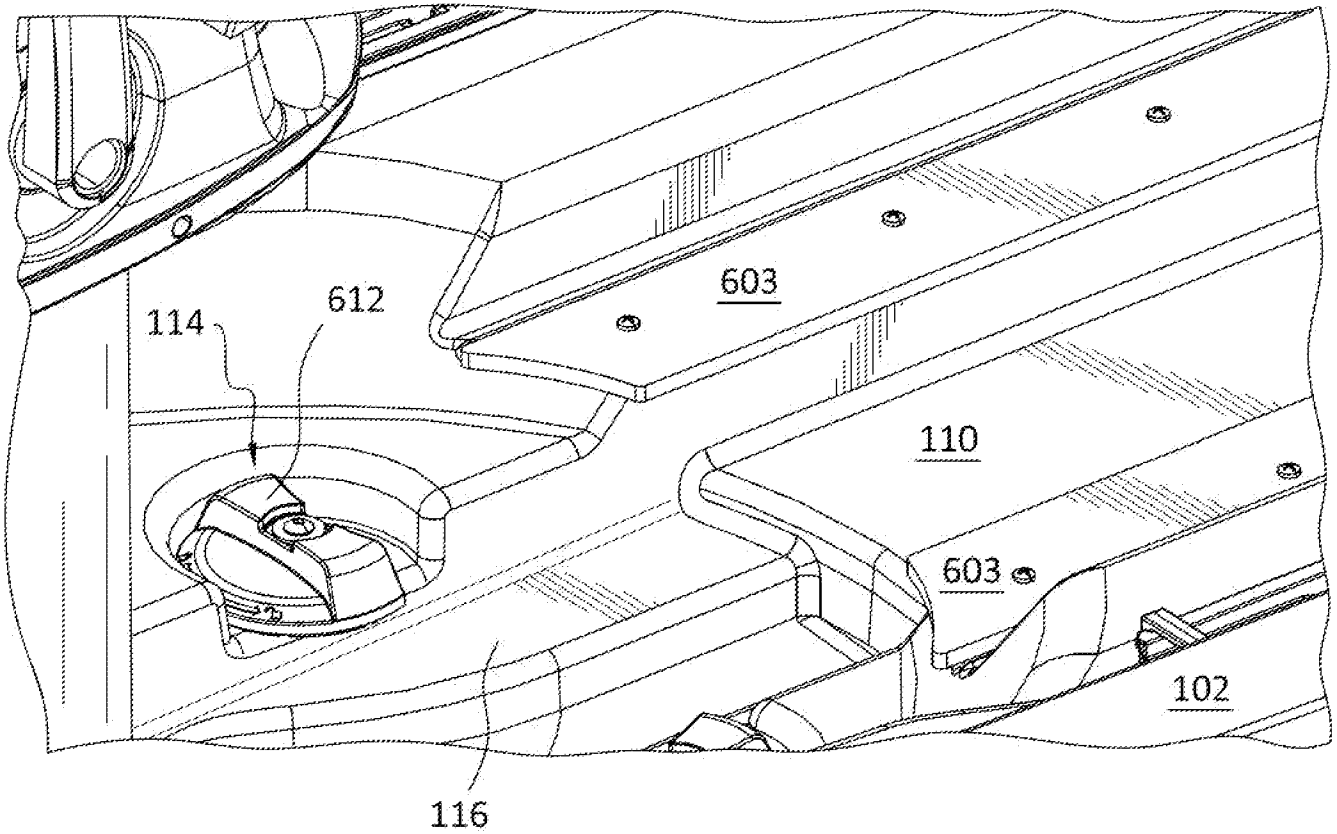

Releasable retention of the tray 602 in the forward position may be further enhanced by way of a lower tray recess 116 that is positioned forward of, and below, the upper tray recess 110, such that the upper tray recess 110 may step down to the lower tray recess 116 (see, e.g., FIGS. 9 and 14). The configuration and arrangement of the lower tray recess 116 may be such that when an attempt is made to move the tray 602 along the lower tray recess 116 to the forward position, the crossbar 606 may interfere with the runners 608. Thus, it may be necessary to tilt the rear of the tray 602 up somewhat so as to enable the runners 608 to fit beneath the crossbar 606 as the tray 602 is moved fully into the forward position (see, e.g., FIGS. 6 and 10). In this way, a pre-load may be applied to the tray 602 by the crossbar 606 acting on the runners 608. As a result of this pre-load, some force may be necessary to push the rear of the tray 602 down to a position where the dogs 612 can be locked over the runners 608. Correspondingly, a reactive force may be exerted by the runners 608 on the dogs 612, such that the tray 602 is thereby more securely retained in the forward position than would be the case if no pre-load had been applied. Finally, when the tray 602 is in the forward position, the arms 604 may be positioned above the crossbar 606 while, as noted, the runners 608 may be positioned below the crossbar 606. The runners 608 and/or the arms 604 may be in contact with the crossbar 606 when the tray 602 is in the forward position.

In some alternative embodiments, the runners 608 may be omitted. In such embodiments, the tray 602 may be made of a suitably stiff and durable material that the runners 608 are not needed. Thus, the dogs in such embodiments may directly contact the tray. Depending upon the material and configuration of the tray, the dogs may be sized such that the contact area between a dog and the tray is relatively large. For example, about 30% to about 50%, or more, of a dog surface may contact the tray when the dog is oriented so as to retain the tray. This relatively large contact area may help to distribute the load imposed by the dog on the tray. In another alternative embodiment, runner stubs are provided at the front of the tray. These runner stubs may not extend along the length of the tray, but may be relatively short sections, such as about 6-12 inches long for example, secured at or near the front of the tray and configured to fit underneath, or otherwise engage, structure such as the crossbar 606, possibly in a manner similar to the way in which the runners 608 engage the crossbar 606. The other portions of the tray in this embodiment may be secured by dogs that may directly contact the tray itself to retain the tray in position. In still another embodiment, the runners and runner stubs may be omitted and the tray may be configured with a structure, or structures, which may or may not be integral with the tray and which are configured to fit underneath, or otherwise engage, structure such as the crossbar 606, possibly in a manner similar to the way in which the runner 608 engage with the crossbar 606.

Secure retention of the tray 602 as disclosed herein may thus help to ensure that the tray 602 does not come adrift, during operation of the watercraft 100, during transition of the pedal-drive mechanism 200 between the deployed and the stowed positions, and/or after the pedal-drive mechanism 200 has been moved to the deployed or stowed position. As well, when in the forward position, the tray 602 may help to prevent ingress of water to the watercraft 100 by way of the well 108.

D. Further Example Embodiments

Following are some further example embodiments of the invention. These are presented only by way of example and are not intended to limit the scope of the invention in any way.

Embodiment 1. A watercraft comprising: a hull that defines a well extending through a bottom of the hull; a pedal-drive mechanism connected to the hull and configured to assume both a stowed position and a deployed position, and a portion of the pedal-drive mechanism extends through the well when the pedal-drive mechanism is in the deployed position; and a pedal-drive housing and attachment mechanism configured to cover a portion of the well at least when the pedal-drive mechanism is in the deployed position.

Embodiment 2. The watercraft as recited in embodiment 1, wherein the pedal-drive housing and attachment mechanism comprises a tray configured to slide between a forward position and an aft position, and the well is at least partly covered by the tray when the tray is in the forward position.

Embodiment 3. The watercraft as recited in embodiment 2, wherein the hull defines an upper recess and a lower recess between which the tray is movable, and the tray resides in the lower recess when the tray is in the forward position, and the tray resides in the upper recess when the tray is in the aft position.

Embodiment 4. The watercraft as recited in any of embodiments 2-3, wherein the tray comprises one or more arms configured, when the tray is in the forward position, to be partly disposed above a crossbar recessed in the hull.

Embodiment 5. The watercraft as recited in any of embodiments 2-4, wherein the tray comprises one or more runners configured, when the tray is in the forward position, to be partly disposed below a crossbar recessed in the hull.

Embodiment 6. The watercraft as recited in embodiment 5, further comprising a dog configured to cooperate with one of the runners to facilitate retention of the tray in a fore-and-aft position.

Embodiment 7. The watercraft as recited in any of embodiments 5-6, further comprising a dog configured to releasably retain one of the runners in a vertical and/or horizontal position when the tray is in the forward position.

Embodiment 8. The watercraft as recited in any of embodiments 6-7, wherein when the tray is dogged, the dog exerts a reaction force to a pre-load imposed by the crossbar on the runner.

Embodiments. The watercraft as recited in any of embodiments 6-8, wherein when the tray is undogged, the tray is movable to the aft position.

Embodiment 10. The watercraft as recited in any of embodiments 1-9, wherein when the pedal-drive mechanism is in the stowed position, the tray is in the forward position, and the pedal-drive mechanism is in contact with the tray.

Embodiment 11. The watercraft as recited in any of embodiments 1-10, wherein the pedal-drive mechanism comprises: a power unit that includes a pair of pedals; a midsection connected to the power unit; and a lower unit having a propeller that is connected indirectly to the pedals.

Embodiment 12. The watercraft as recited in embodiment 10, wherein: the lower unit is positioned underneath the hull when the pedal-drive mechanism is in the deployed position; and when the pedal-drive mechanism is in the stowed position, the lower unit is no longer positioned underneath the hull.

Embodiment 13. The watercraft as recited in any of embodiments 1-12, wherein the watercraft comprises an hollow, single-piece, structure made of plastic.

Embodiment 14. The watercraft as recited in in any of embodiments 1-13, wherein the watercraft comprises a kayak.

Embodiment 15. A watercraft comprising: a hull that defines a well extending through a bottom of the hull, and the hull defines an upper tray recess and a lower tray recess; a pedal-drive mechanism connected to the hull and configured to assume both a stowed position and a deployed position, and a portion of the pedal-drive mechanism extends through the well when the pedal-drive mechanism is in the deployed position; and a pedal-drive housing and attachment mechanism that comprises a tray configured to move between a forward position in which part of the tray resides in the lower tray recess, and an aft position in which part of the tray resides in the upper tray recess.

Embodiment 16. The watercraft as recited in embodiment 15, wherein the tray is configured and arranged so that when the pedal-drive mechanism is in the stowed position, the pedal-drive mechanism is supportable by the tray.

Embodiment 17. The watercraft as recited in in any of embodiments 15-16, wherein the tray is configured to be releasably secured in the lower tray recess.

Embodiment 18. The watercraft as recited in any of embodiments 15-17, wherein when the tray is in the forward position, the tray covers part of the well.

Embodiment 19. The watercraft as recited in any of embodiments 15-18, wherein the tray defines a cutout that is aligned with the well when the tray is in the forward position, and the pedal-drive mechanism extends through the cutout and into the well when the pedal-drive mechanism is in the deployed position and the tray is in the forward position.

Embodiment 20. The watercraft as recited in any of embodiments 15-19, wherein the pedal drive mechanism comprises a pair of pedals indirectly connected to a propeller.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A watercraft comprising:

a hull that defines a well extending through a bottom of the hull;

a pedal-drive mechanism connected to the hull, and the pedal-drive mechanism is movable, while connected to the hull, out of the well from a deployed position to a stowed position; and a mechanism configured to slide fore and aft between a first position and a second position, and when the mechanism is in the second position and the pedal-drive mechanism is in the deployed position, the mechanism covers a portion of the well.

2. The watercraft as recited in any claim 1, wherein the hull comprises a hollow, single-piece, structure made of plastic.

3. The watercraft as recited in claim 1, wherein the watercraft comprises a kayak.

4. The watercraft as recited in claim 1, wherein the pedal-drive mechanism comprises:

a power unit that includes a pair of pedals;

a midsection connected to the power unit; and a lower unit connected to the midsection and including a propeller that is connected indirectly to the pedals.

5. The watercraft as recited in claim 4, wherein:

the lower unit is positioned underneath the hull when the pedal-drive mechanism is in the deployed position; and the lower unit is positioned in a cockpit of the hull when the pedal-drive mechanism is in the stowed position.

6. The watercraft as recited in claim 1, wherein the mechanism comprises a tray that is movable between a forward position and an aft position, and part of the well is covered by the tray when the tray is in the forward position.

7. The watercraft as recited in claim 6, wherein the tray comprises one or more runners configured, when the tray is in the forward position, to be positioned under a crossbar recessed in the hull.

8. The watercraft as recited in claim 6, wherein the hull defines an upper tray recess and a lower tray recess between which the tray is movable.

9. The watercraft as recited in claim 6, wherein the tray resides in a lower tray recess when the tray is in the forward position, and the tray resides in an upper tray recess when the tray is in the aft position.

10. The watercraft as recited in claim 6, wherein when the pedal-drive mechanism is in the stowed position, the tray is in the forward position, and the pedal-drive mechanism is positioned above the tray.

11. The watercraft as recited in claim 6, wherein when the tray is in the forward position, and the pedal-drive mechanism is in the stowed position, the tray prevents the pedal-drive mechanism from being moved to the deployed position.

12. An apparatus, comprising:

a pedal-drive mechanism connectible to a hull of a watercraft that includes a well, and the pedal-drive mechanism is movable, when connected to the hull, out of the well from a deployed position to a stowed position; and a mechanism configured to slide fore and aft between a first position and a second position, and when the mechanism is in the second position and the pedal-drive mechanism is in the deployed position, the mechanism covers a portion of the well.

13. The apparatus as recited in claim 12, wherein the pedal-drive mechanism comprises:

a power unit that includes a pair of pedals;

a midsection connected to the power unit; and a lower unit connected to the midsection and including a propeller that is connected indirectly to the pedals.

14. The apparatus as recited in claim 12, wherein the mechanism comprises a movable tray that covers part of the well when the pedal-drive mechanism is connected to the hull and the pedal-drive mechanism is in the stowed position.

15. The apparatus as recited in claim 14, wherein the tray is configured and arranged so that when the pedal-drive mechanism is connected to the hull and is in the stowed position, the pedal-drive mechanism is supportable by the tray.

16. The apparatus as recited in claim 1, wherein the mechanism is unconnected to the pedal-drive mechanism.

* * * * *